US008845373B2

(12) United States Patent
Lausman

(10) Patent No.: US 8,845,373 B2
(45) Date of Patent: Sep. 30, 2014

(54) FIN SYSTEM

(76) Inventor: Tom Roger Lausman, Rotterdam (NL)

( * ) Notice: Subject to any disclaimer, the term of this patent is extended or adjusted under 35 U.S.C. 154(b) by 309 days.

(21) Appl. No.: 12/994,149

(22) PCT Filed: May 22, 2009

(86) PCT No.: PCT/NL2009/000121

§ 371 (c)(1),
(2), (4) Date: Nov. 22, 2010

(87) PCT Pub. No.: WO2009/142479

PCT Pub. Date: Nov. 26, 2009

(65) Prior Publication Data

US 2011/0070787 A1 Mar. 24, 2011

(30) Foreign Application Priority Data

May 23, 2008 (NL) ..... 1035464

(51) Int. Cl.
*B63B 35/79* (2006.01)

(52) U.S. Cl.
CPC ..... *B63B 35/793* (2013.01)
USPC ..... 441/79

(58) Field of Classification Search
USPC ..... 114/39.15, 39.24, 127, 140; 441/79
See application file for complete search history.

(56) References Cited

U.S. PATENT DOCUMENTS

| | | | | |
|---|---|---|---|---|
| 4,398,485 | A * | 8/1983 | Diziere | 114/132 |
| 5,934,962 | A * | 8/1999 | Daum et al. | 441/79 |
| 5,975,974 | A * | 11/1999 | McCausland | 441/79 |
| 6,764,364 | B1 | 7/2004 | Hickman | |
| 6,991,504 | B1 | 1/2006 | English | |
| 2002/0039866 | A1 * | 4/2002 | Jolly et al. | 441/79 |
| 2003/0087564 | A1 | 5/2003 | Kelley | |
| 2006/0189230 | A1 | 8/2006 | Sams et al. | |

FOREIGN PATENT DOCUMENTS

EP 0034990 A 9/1981

* cited by examiner

*Primary Examiner* — Edwin Swinehart
(74) *Attorney, Agent, or Firm* — David A. Guerra

(57) ABSTRACT

The invention relates to a connection between a fin (skeg) or daggerboard for a vessel and a vessel, in particular a sailboard or aquafoil, such as a kite board, windsurfing board, surf board, body board, wake board or water ski, which sailboard is provided with a fin box, whereby the fin box is provided with first fastening means, and whereby the fin is provided with second fastening means that co-operate with the first fastening means of the fin box upon engagement therewith. The first fastening means and the second fastening means are embodied such that they form a releasable cantilever snap fit upon engagement with each other. The snap fit is releasable.

18 Claims, 24 Drawing Sheets

FIN SYSTEM

CROSS-REFERENCE TO RELATED APPLICATIONS

This application is an U.S. national phase application under 35 U.S.C. §371 based upon co-pending International Application No. PCT/NL2009/000121 filed on May 22, 2009. Additionally, this U.S. national phase application claims the benefit of priority of co-pending International Application No. PCT/NL2009/000121 filed on May 22, 2009, and Netherland Application No. 1035464 filed on May 23, 2008. The entire disclosures of the prior applications are incorporated herein by reference. The international application was published on Nov. 26, 2009 under Publication No. WO 2009/142479.

BACKGROUND OF THE INVENTION

1. Field of the Invention

The present invention relates to a fin system or connection between a fin (skeg) or daggerboard for a vessel and a vessel, in particular a sailboard or aquafoil, such as a kite board, windsurfing board, surf board, body board, wake board or water ski. The invention also relates to a fin and a fin box (well) suitable for use with the fin system according to the invention.

2. Description of the Prior Art

Although the invention has a broad application, it will be referred hereinafter in short to a fin system and to its application relating to a surf board.

Such fin systems are known in different forms in practice. One form is as follows. A surf board is provided with a mounting box, also known as a fin box or well, sunken in the board at the position where a fin that is to be mounted is to be inserted substantially perpendicularly with respect to the plane of the surf board lying in the water. The fin box is provided locally with first fastening means, such as bore holes, screw holes and suchlike, with which by means of engagement with second fastening means, such as bolts, screws, plugs and suchlike, which a fin has been provided with, the fin can be connected to the fin box and therewith to the surfboard.

A fin serves for compensating the lateral force that in most faring directions is exerted on a surfboard. As a result of this lateral force, were a fin not to be present, the surfboard would not move in the desired direction, with the exception of faring downwind.

The fin will, however, not only provide the desired compensation with respect to the lateral force and directional stability, but also give rise to a certain drag, which must be as small as possible. A fin is therefore designed with regard to optimum hydrodynamic performance within a given set of conditions. When conditions change, for example when higher waves occur, in which a certain fin does not perform optimally, then a need for a different type of fin arises. In practice, a fin is then replaced by a different type of fin, the choice of which is dependent of the desired faring properties.

Also, wear of a different type of erosion of the connection of a fin with the board, or damage to the fin itself, give rise to replacement of the fin. Transportation of a board also forms a reason for removal of a fin.

Since known fins are often connected to surfboards by means of bolts, screws, plugs and suchlike, mounting and removal of the fin are time-consuming. Moreover, hand-held tools are required for mounting and release.

SUMMARY OF THE INVENTION

An object of the invention is to provide a fin system which can be both formed as well as released as quickly as possible.

Another object of the invention is to provide a fin system which can be formed and released with mountable and releasable means that are as simple as possible.

Another object of the invention is to provide a fin system with a working that is as optimum as possible when applied in different faring conditions.

According to the invention, a fin system or connection between a fin (skeg) or daggerboard for a vessel and a vessel, in particular a sailboard or aquafoil, such as a kite board, windsurfing board, surf board, body board, wake board or water ski, which sailboard is provided with a fin box, whereby the fin box is provided with first fastening means, and whereby the fin is provided with second fastening means that co-operate with the first fastening means of the fin box upon engagement therewith, characterized in that the first fastening means and the second fastening means are embodied such that they form a cantilever snap fit upon engagement with each other.

An advantage of this technical feature is that no tool is any longer required for creating the fin system.

Another advantage is that the fin system can be made with narrow tolerances by which a high degree of fit can be achieved.

Preferably, the fin connection or snap fit according to the invention is releasable. An advantage of this is that the connection can be used several times. Another advantage is that a fin can be replaced quickly and easily.

Preferably, in the snap fit the first fastening means of the fin box comprise a functional hook and the second fastening means of the fin comprise a receptacle suitable for receiving the functional hook. An advantage of this is that the means for letting the functional hook retract back from the functional hook when releasing the snap fit can be incorporated in the first fastening means themselves. By this the means for retracting the functional hook can be made more robust then when the means for letting the functional hook retract are to be incorporated in the second fastening means of the (removable) fin.

Preferably, the first fastening means are removable in a fin box that is suitable for use with a fin system according to the invention. The advantage hereof is that when the functional hook has worn out after long and multiple use, it can be replaced quickly and easily so that a good connection of a fin to the sailboard can be ensured once again. The components of the first fastening means may hereby comprise different materials, such as for example plastics and (resilient) steel.

It is advantageous with regard to production to embody the first fastening means as a unitary entity. It is advantageous with regard to replacement to embody the first fastening means as a multi-part entity.

Preferably, the first fastening means of a fin box according to the invention comprise a number of ribs and receptacles that are suitable for co-operation with corresponding receptacles and ribs of a fin that is to be received in the fin box. The advantage hereof is that the fin system that is created becomes so robust that it is resistant to lateral forces, torsion forces and suchlike which are exerted on the fin during use.

Preferably, the first fastening means of a fin box according to the invention comprise a space in which a part of the functional hook can retract when releasing the fin system. The advantage hereof is that the functional hook of the fin box and its corresponding receptacle of the fin can be separated from each other quickly and without the use of much force.

Preferably, the space in which a part of the functional hook can retract when releasing the fin system comprises a stop for limiting the degree of retraction of the functional hook. The advantage hereof is that the functional hook does not deform too much so that it can be used for a long time.

Preferably, the first fastening means of a fin box according to the invention comprise auxiliary means for enhancing the retraction of the functional hook when releasing the snap fit. The advantage hereof is that the functional hook of the fin box and its corresponding receptacle of the fin can be separated from each other quickly and without the use of much force. The auxiliary means can be a spring, for example. A part of the first fastening means can be embodied in a C-shape or U-shape so that this part can compress when a part of the functional hook retracts when releasing the fin system. The compressible part can then be considered to embody the enhancing function of the intended auxiliary means.

Preferably, the functional hook of the first fastening means of a fin box according to the invention comprises a beveled plane at its side that is received in the second fastening means during engagement. The advantage hereof is that the snap fit can be easily formed and released.

Preferably, the first fastening means of a fin box of the snap fit a beveled plane there where it comes into contact with the upper edge of the fin box when being received in the fin box. The advantage hereof is that the beveled plane eases the compression of the first fastening means.

Preferably, in a fin that is suitable for use with a fin system according to the invention, the receptacle in the second fastening means for receiving the functional hook comprises a beveled plane at its side that comes into contact with the functional hook during engagement. The advantage hereof is that the snap fit can be easily formed and released.

Preferably, the receptacle extends at least across a part of the breadth of the fin. The advantage hereof is that the functional hook which is to be received in the receptacle can then be of limited breadth.

Preferably, the receptacle extends substantially horizontally. The advantage hereof is that the receptacle can be formed just above the footing of the fin and when forming the fin system the receptacle together with the footing can be received in a sunken manner in the fin box.

Preferably, a fin that is suitable for use with a fin system according to the invention comprises a single footing. This is advantageous with regard to the ease of use.

Preferably, the second fastening means of a fin according to the invention comprise a number of ribs and receptacles that are suitable for co-operation with corresponding receptacles and ribs of a fin box in which the fin is to be received. The advantage hereof is that during co-operation the fin system that is created becomes so robust that it is resistant to lateral forces, torsion forces and suchlike which are exerted on the fin during use.

Preferably, a fin box and a fin that are suitable for use with a fin system according to the invention comprise a number of co-operating ribs and corresponding receptacles, such that the fin can be connected to the fin box at more than one position relative to the fin box and thus (relative) to the sailboard. This has the advantage that a fin can be (re)positioned quickly and easily in response to changing faring conditions.

Preferably, a fin box that is suitable for use with the fin system according to the invention is provided with an auxiliary means or adapter with which also fins other than a fin according to the invention, such as for example a fin with more than one separate footings, can be connected to the fin box, whereby the auxiliary means or adapter comprises one or more of the described technical functional features of a fin according to the invention, such that different types of fins can also be connected to the fin box by means of the fin system according to the invention. The auxiliary means or adapter is preferably releasable.

Further aspects and advantages of the invention will be mentioned and elucidated in the description.

BRIEF DESCRIPTION OF THE DRAWINGS

The invention shall now be further elucidated by examples of embodiments that are shown in the drawings, in which.

DESCRIPTION OF THE PREFERRED EMBODIMENT

Figure 1A:
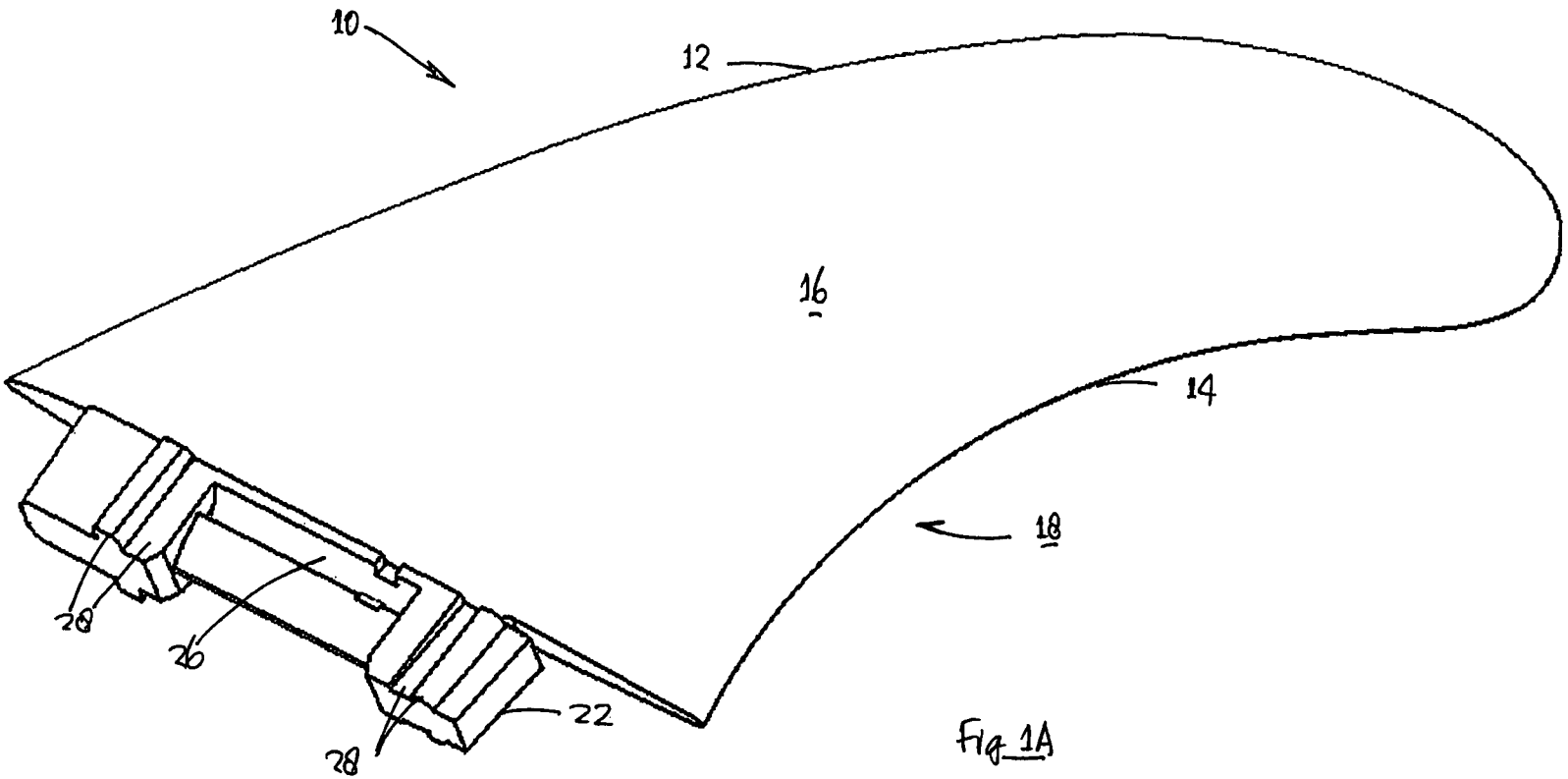
FIGS. 1A, 1B and 1C depict perspective views of a fin according to the invention.
Figure 1B:
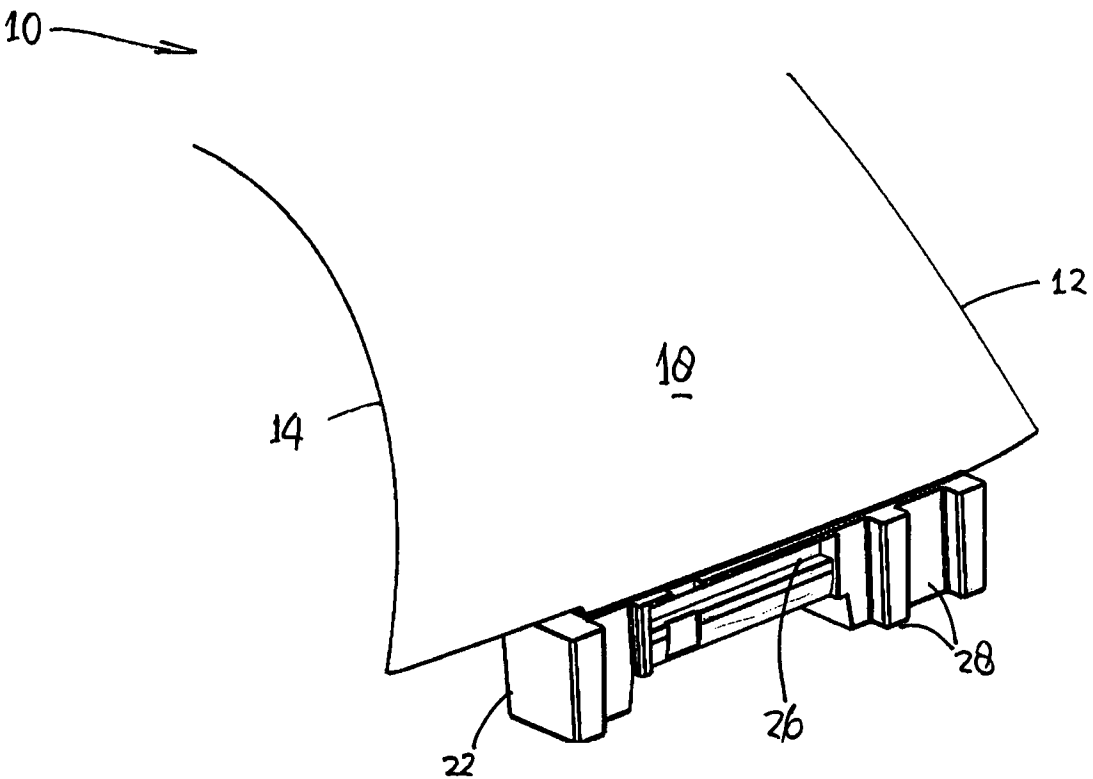
Figure 1C:
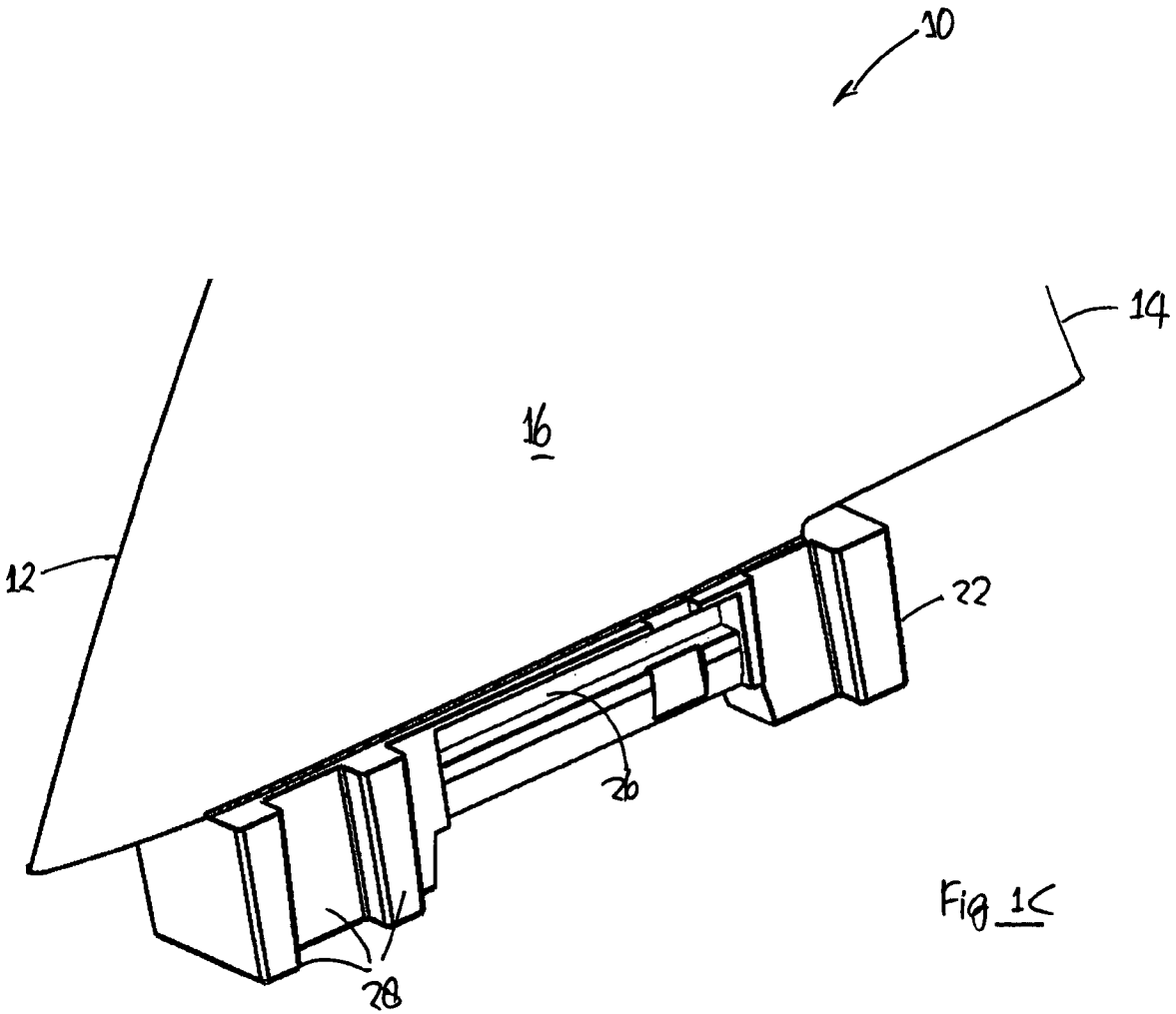

A fin according to the invention is shown in FIG. 1A. This fin 10 comprises a front rib 12, a rear rib 12, a pair of sides 16 and 18, a point 20 and a footing 22. The sides of the fin are streamlined. The fin according to the invention can best be formed from a piece of plastic or suchlike. Views of both sides of the footing of the fin are depicted in FIGS. 1B and 1C.

The end of the fin 10 near the footing 22 is substantially linear. When the fin is received in a fin box of a sailboard, the footing 22 of the fin 10 comes to lie completely sunken in the fin box so that a substantially closed surface is formed at the bottom of the sailboard.

The footing 22 comprises at least one channel 26 which extends substantially horizontally across at least a part of the length of the footing 22. The channel 26 forms part of the second fastening means of the fin according to the invention. This channel 26 serves the purpose of co-operating with and receiving herein of, at least a part of, a complementarily formed rib that is comprised in the first fastening means of a fin box in which the fin 10 is to be received and releasably fastened. At least one side of the channel 26 is beveled for enhancing the formation and release of the fin system in co-operation with the first fastening means of a fin box.

The footing 22 of the fin 10 further comprises various ribs 28A and receptacles 28B which serve for a tight-fitting co-operation in complementarily formed receptacles and ribs, respectively, of the first fastening means of a fin box. When engaging with each other, these ribs and receptacles provide strength to the connection which arises between the second fastening means of the fin and the first fastening means of the fin box. In the example that is depicted these ribs 28A and receptacles 28B are orientated substantially vertically.

Figure 2:
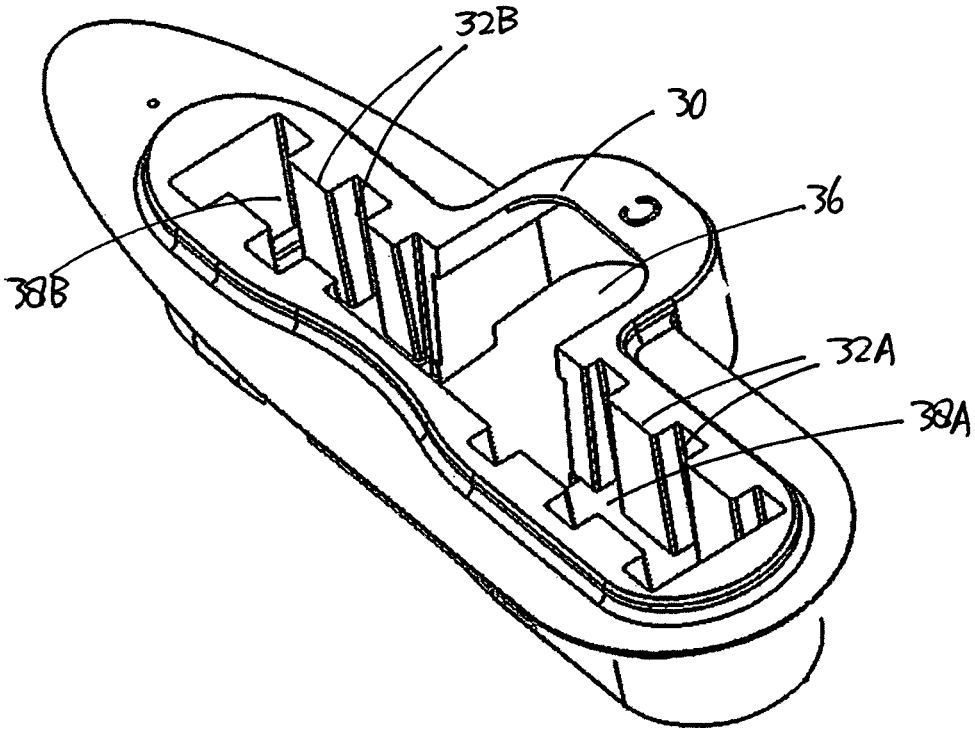
FIG. 2 schematically depicts a view of an example of a fin box according to the invention, as seen in a direction in which a fin is to be received in the fin box.

In FIG. 2 a fin box 30 is depicted which is suitable for receiving a fin according the invention therein. The fin box 30 can be seen in a top view, that is to say, when the fin box is taken up in a sailboard as seen in the depicted orientation, then one can see the underside or bottom of the sailboard. The fin box 30 comprises a number of first receptacles 32A that are formed complementarily with respect to the ribs 28A of the fin and a number of first ribs 32B that are formed complementarily with respect to the receptacles 28B of the fin, second receptacles 34 and a third receptacle 36. Fourth receptacles 38A and 38B are formed on either side of the third receptacle 36 which are partly separated from the third receptacle 36. The fourth receptacles 38A and 38B serve the purpose of receiving therein a footing of a fin or an auxiliary means or adapter. These receptacles 32A, ribs 32B, ribs 34, receptacle 36 and receptacles 38A and 38B form part of the first fastening means of the fin box 30. The functions of the receptacles 32A, ribs 32B, ribs 34, receptacle 36 and receptacles 38A and 38B will be described later.

Figure 3:
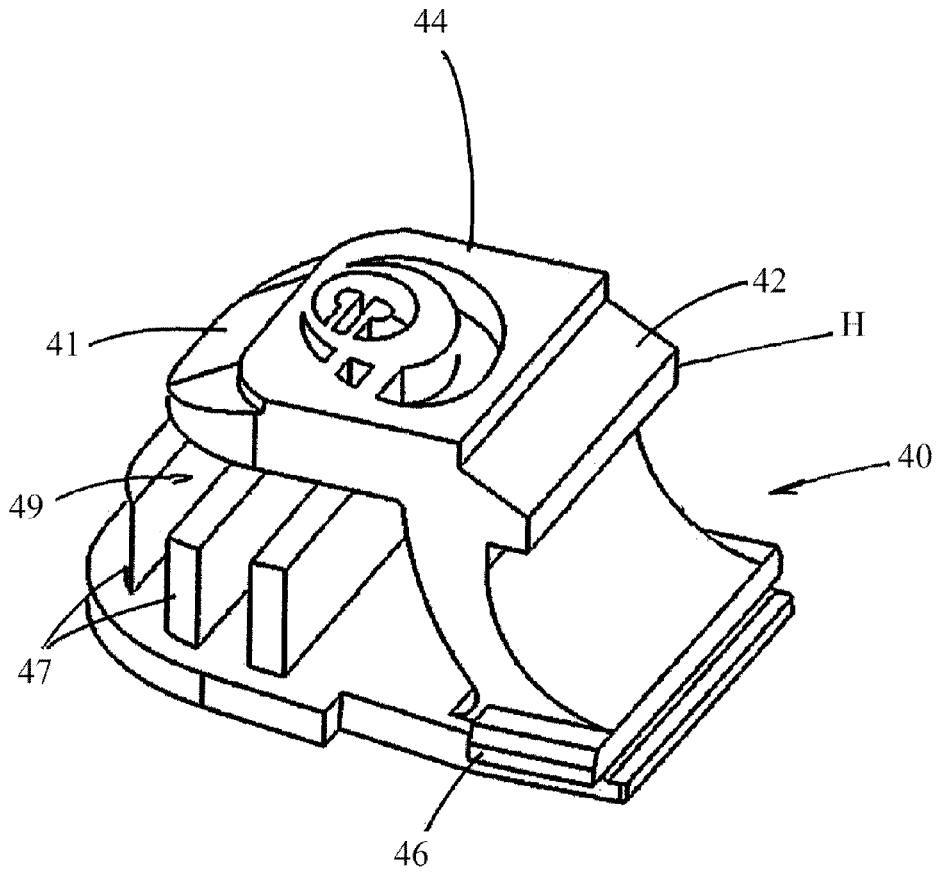
FIG. 3 depicts a perspective view of the first fastening means embodied in the form of a unitary component that comprises inter alia a functional hook for the purpose of forming a fin system according to the invention.

The first fastening means of a fin box according to the invention are depicted in a perspective view in FIG. 3. The first fastening means are embodied in the form of a unitary part 40. The part 40 comprises a functional hook H and compressible or resilient means 44. Means 44 serve the purpose of allowing the functional hook H to retract from a state of engagement with the second fastening means of a fin according to the invention. The hook H comprises a rib 42. This rib 42 preferably comprises a beveled plane so that the hook H can easily be brought into and out of a state of engagement with the second fastening means of a fin. Means 44 preferably comprise a beveled plane 41 there where when being received in the fin box it comes into contact with the upper edge of the fin box. The beveled plane 41 makes the compression of means 44 easy. The unitary part 40 also comprises a number of notches 46 of which only one is depicted here. In the depicted orientation the unitary part 40 can be received in whole in the receptacle 36 of the fin box in the orientation according to FIG. 2. When taken up, the notches 46 of the unitary part 40 co-operate with the receptacles 34 of the fin box for forming a connection between the two.

Figure 4:
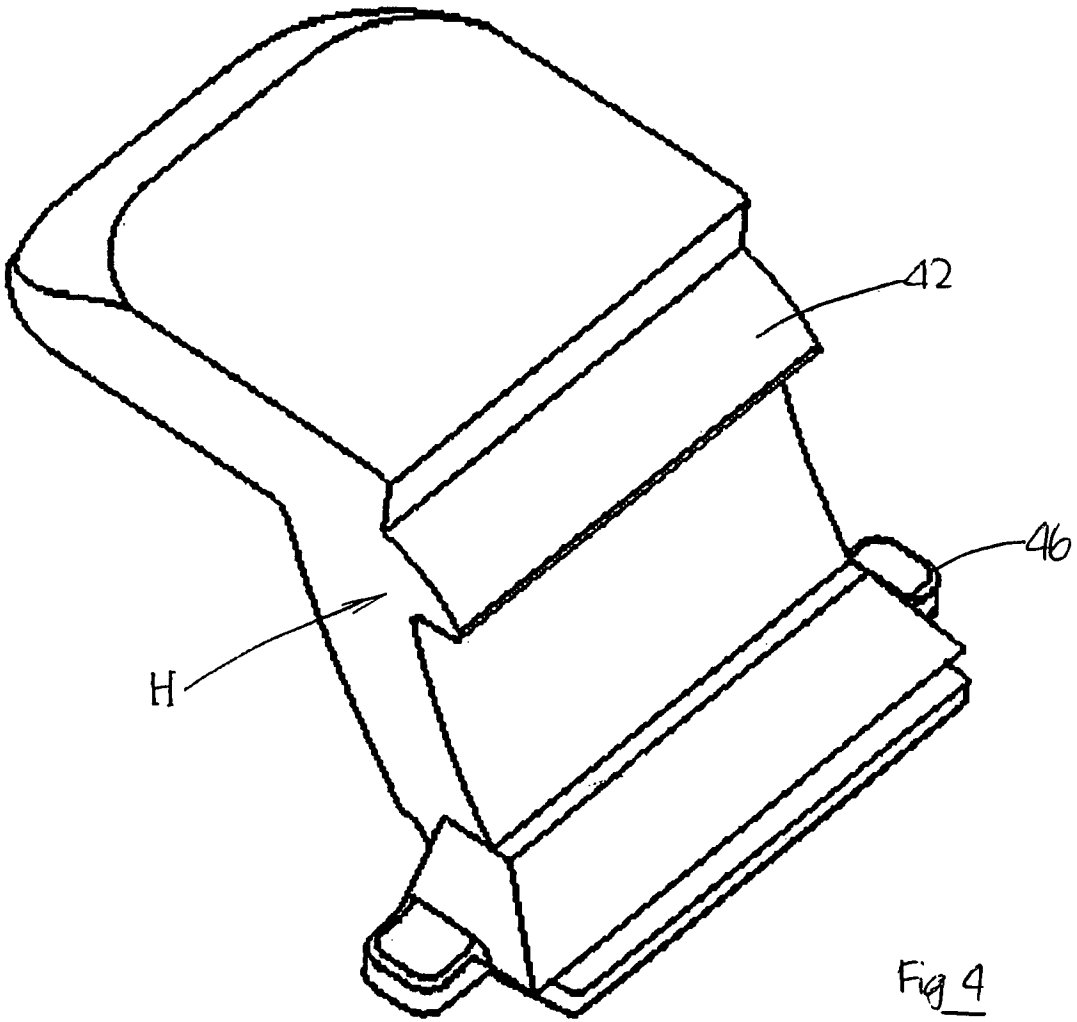
FIG. 4 depicts a perspective view of a part of the first fastening means of the fin box according to the invention in a multi-part embodiment.

A functional hook H that is formed as separate from compressible means 44 is depicted in FIG. 4. In this example of an embodiment the functional hook also comprises notches 46 which have the same function as the one described above in relation to FIGS. 2 and 3.

Figure 5:
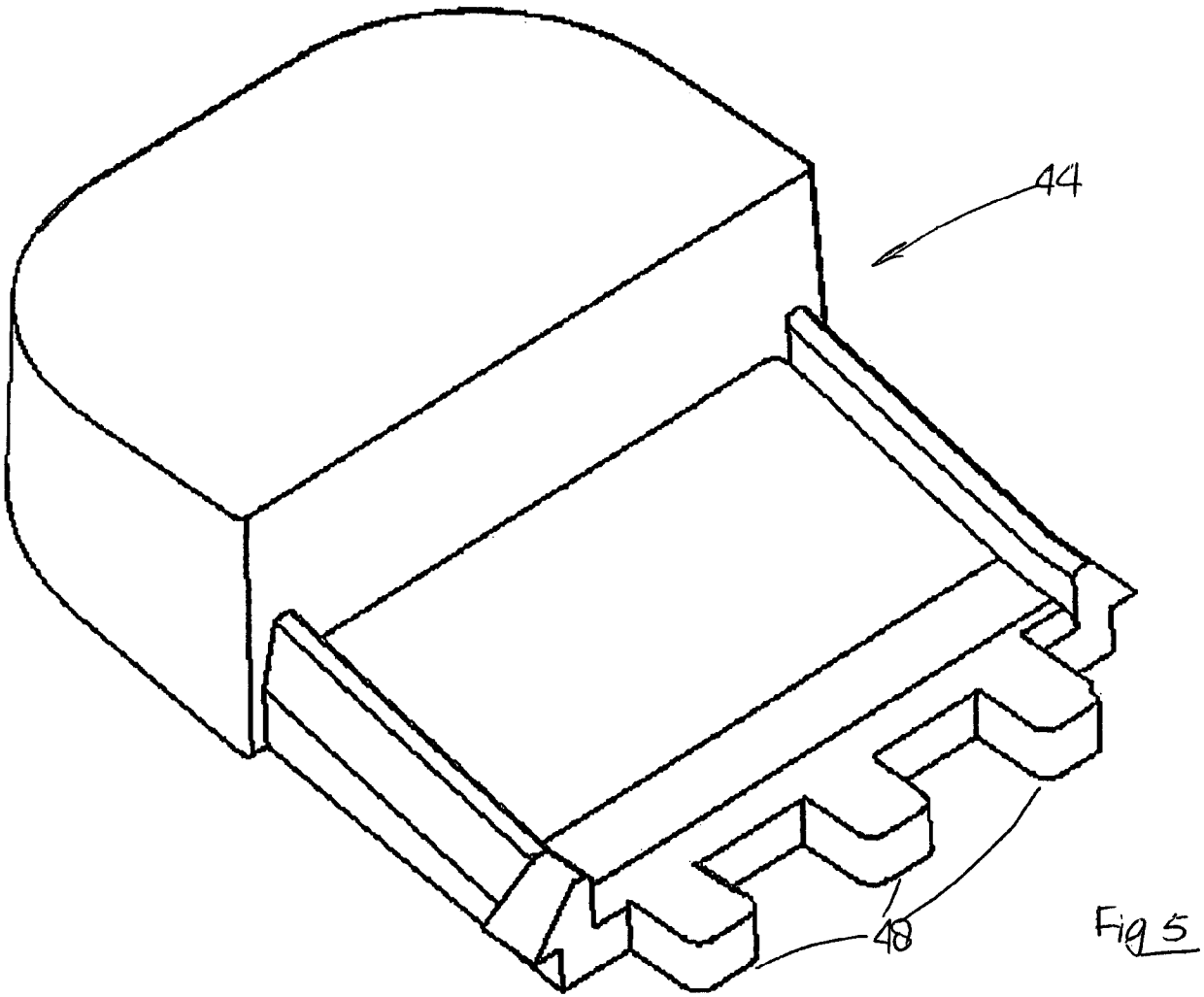
FIG. 5 depicts a perspective view of another part of the first fastening means of the fin box according to the invention in a multi-part embodiment, whereby the parts according to FIGS. 4 and 5 co-operate with each other for forming the first fastening means.

Compressible or resilient means 44 that are formed as separate from a functional hook are shown in FIG. 5. In the depicted view the means 44 lie below the plane of drawing. A number of notches 48 can also be seen of which the function will be described later.

It shall be clear that in both embodiments of the first fastening means the resilient properties thereof are such that in a state of engagement with the functional hook H and the receptacle 26 of the fin that co-operates with it, the functional hook is pressed into the receptacle and the beveled plane 41 at its top side is pressed against the upper edge of the fin box. In this manner the fin system is secured and the means 44 together the fin box surrounding these means form a substantially closed surface. The advantage hereof is that during use there is as little disturbance of the flow pattern of water locally at the fin connection as is possible.

It shall be clear that the resilient properties of the first fastening means are such that in a state in which the first fastening means have been received in the fin box but a fin has not yet been received therein, the beveled plane 41 at its top side is pressed against the upper edge of the fin box.

Figure 6:
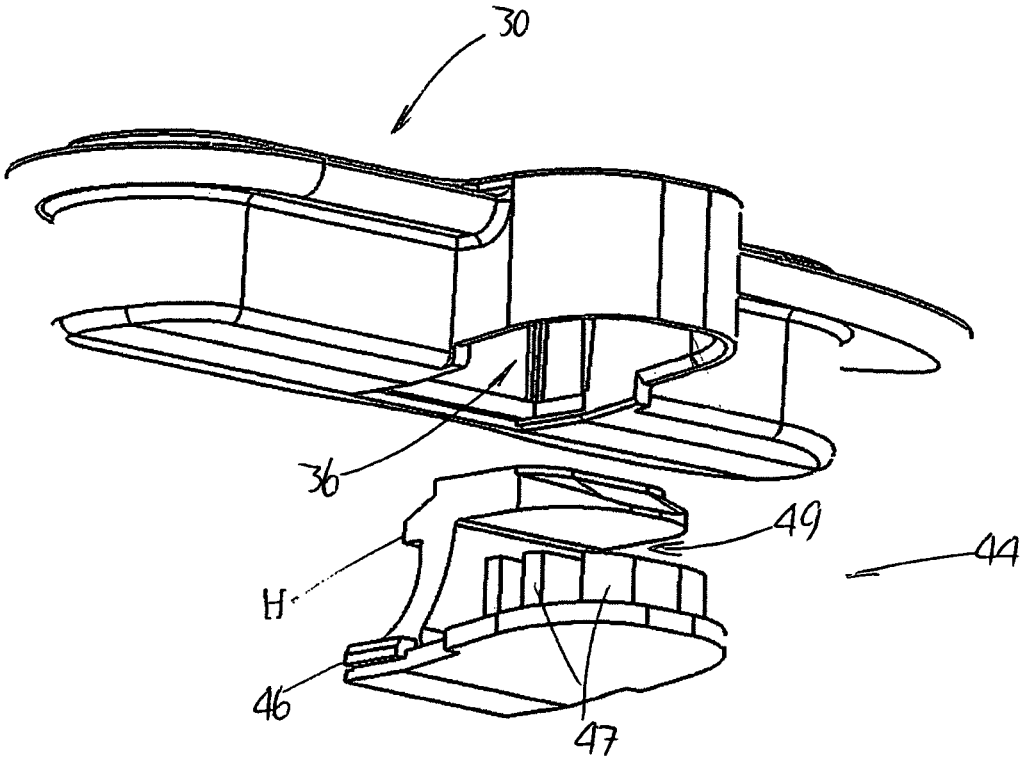
FIG. 6 depicts a perspective view of the relative positions of a fin box according to FIG. 2 and the first fastening means according to FIG. 3 with respect to each other in a state preceding assembly.

FIG. 6 depicts the relative positions of a fin box according to FIG. 2 and the first fastening means according to FIG. 3 with respect to each other in a state preceding assembly. Means 47 serve as a stop for limiting the degree in which the compressible or resilient means 44 can retract in the space 49 from the state of engagement with the second fastening means of a fin. In the plane of drawing the first fastening means that are depicted can be brought in the fin box from below. The first fastening means can just as well be designed by the skilled person in the art such that these means can be brought in the fin box from above.

FIGS. 7-10 depict a number of states of assembly of the separately formed functional hook H and compressible or resilient means 44 with the fin box 30 also being shown.

Figure 7:
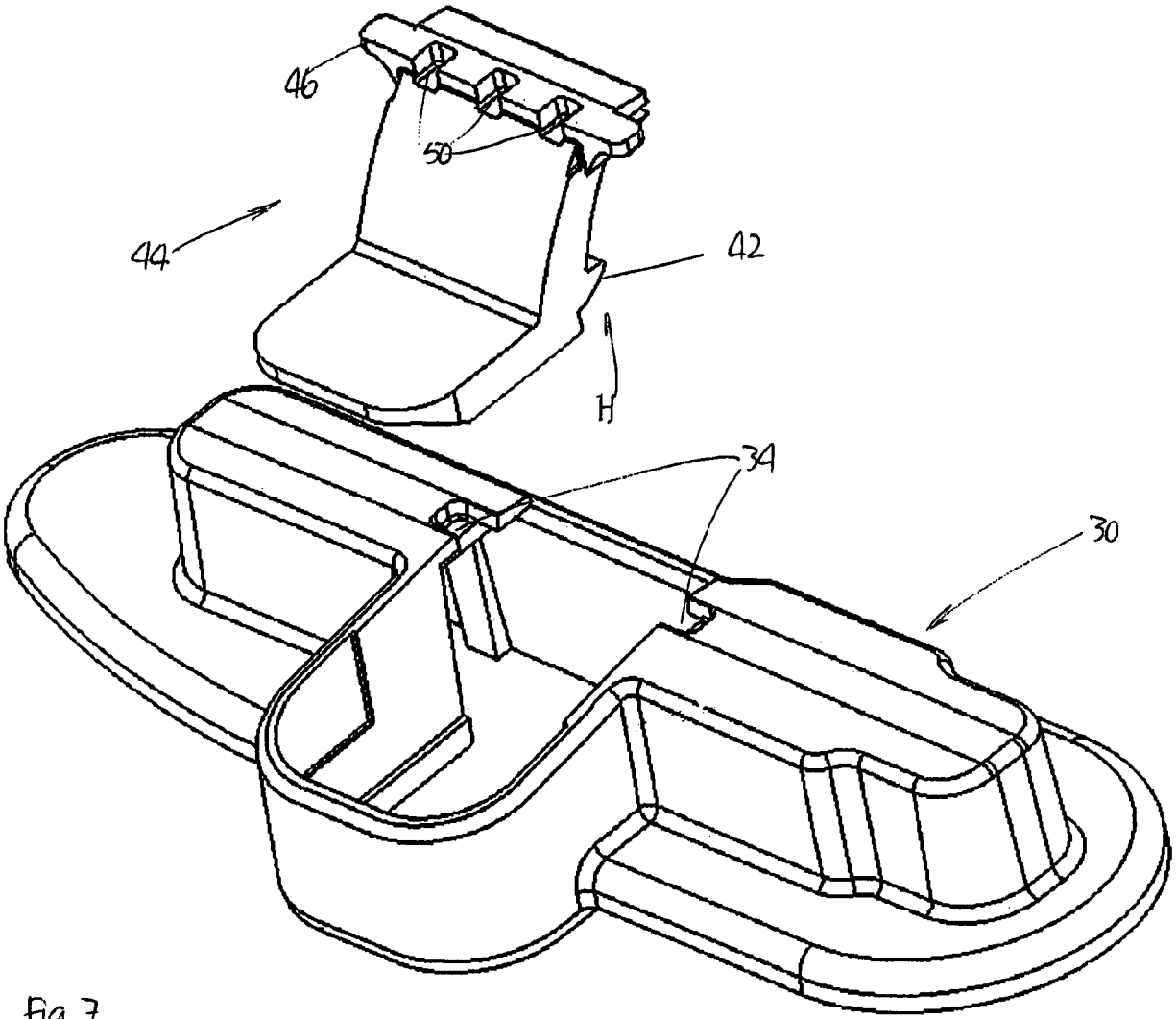
FIGS. 7-10 schematically depict a number of views of states of assembly of the fin box according to FIG. 2 and the multi-part embodiment of the first fastening means according to FIGS. 4 and 5.

In FIG. 7 the fin box 30 is depicted in a view as seen from below, that is to say, the fin box 30 can be seen at its underside which when received in the sailboard is visible from the top side of the sailboard. It shall be clear that when taken up the underside of the fin box 30 will lie flush with the top side of the sailboard. A number of receptacles of the depicted functional hook H can be seen of which the function will be described later.

Figure 8:
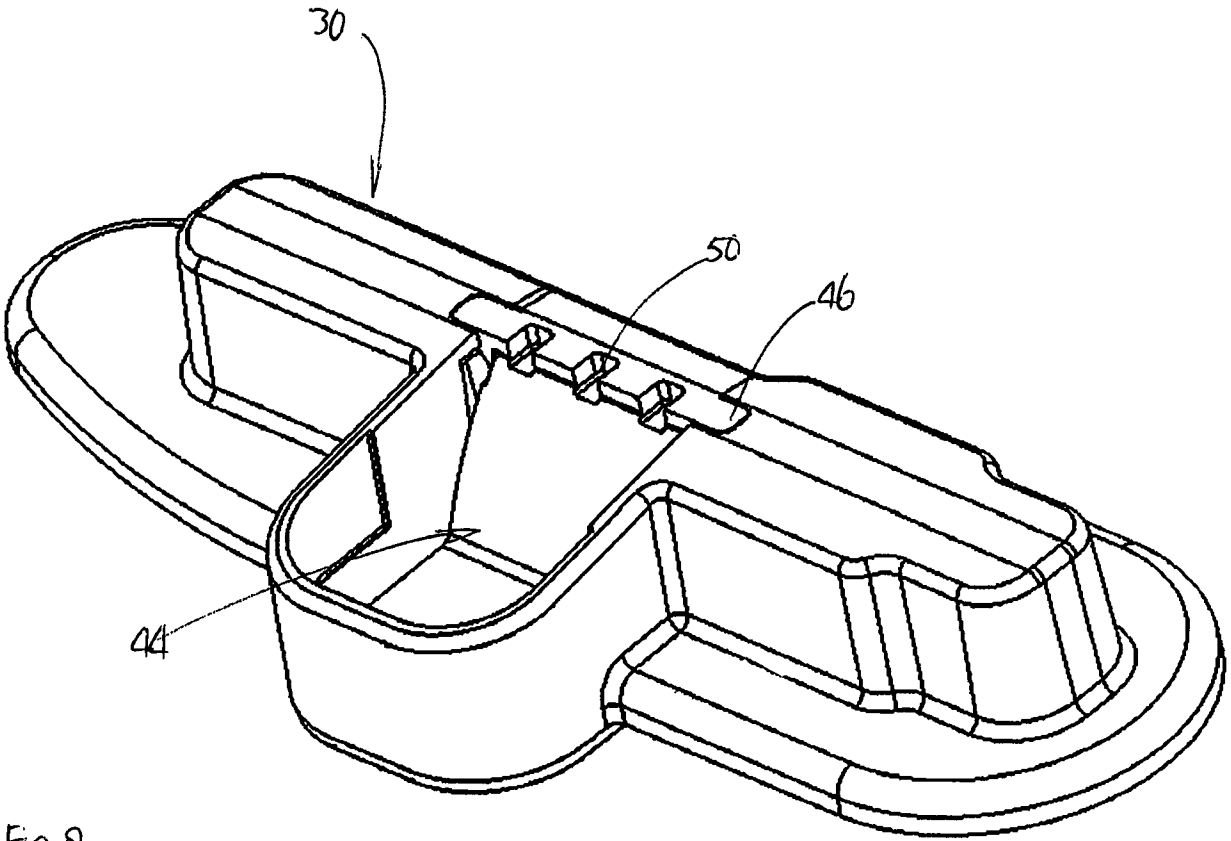

In FIG. 8 the functional hook H is depicted in its state when it has been taken up in whole in the fin box 30. In this orientation the receptacles 46 of the functional hook 46 are flush with the underside of the fin box 30.

Figure 9:
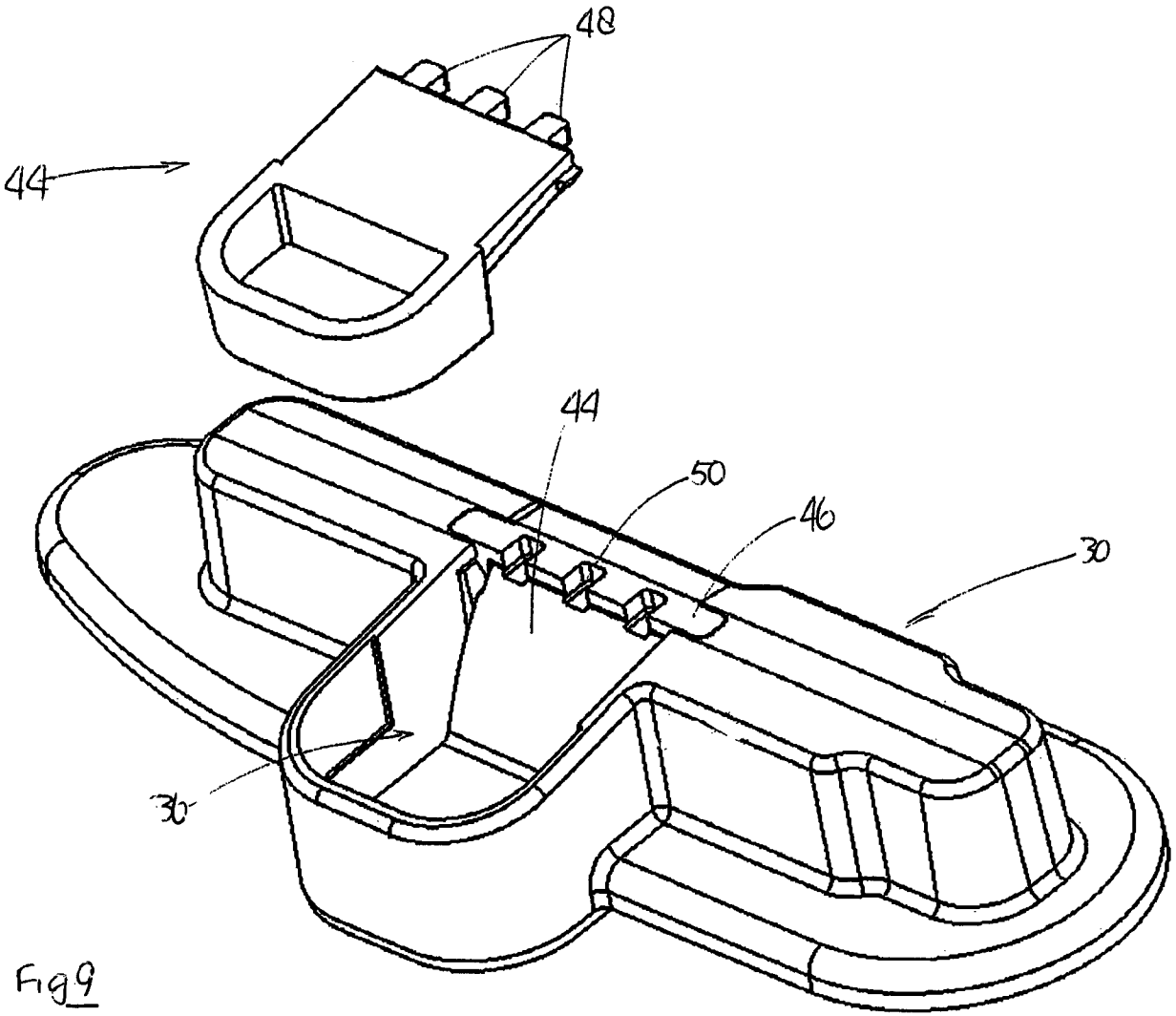

In FIG. 9 separately formed compressible or resilient means 44 are depicted in an orientation whereby these are to be assembled with the functional hook H and fin box that have already been assembled together. When assembling the compressible or resilient means 44 in the hollow space 36 of the fin box 30 in which the functional hook H has already been taken up, the notches 50 of the compressible or resilient means 44 co-operate with the receptacles 48 of the functional hook H.

Figure 10:
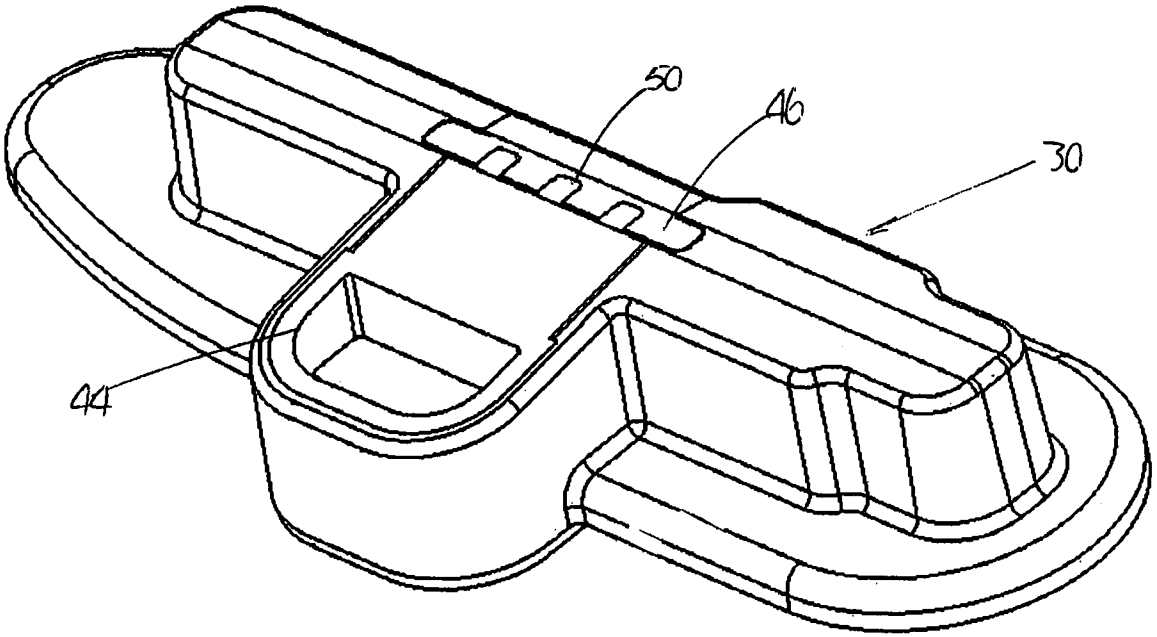

In FIG. 10 the result of assembly of the compressible or resilient means 44 with the already assembled functional hook H and fin box 30 is shown. The top surface of the compressible or resilient means 44, the notches 46 and the underside of the fin box 30 thereby lie in substantially one plane.

Figure 11:
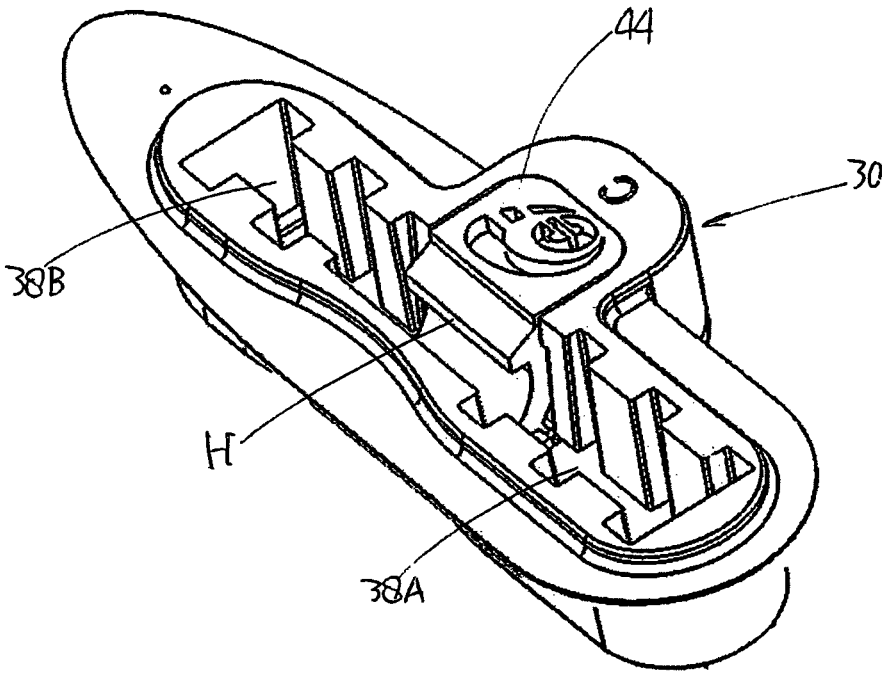
FIG. 11 depicts a perspective view of a state of assembly of the fin box according to FIG. 2 and the unitary embodiment of the first fastening means according to FIG. 3.

In FIG. 11, as a comparison with the result according to FIG. 10, the result of assembly of the unitary formed first fastening means according to FIG. 3 in the fin box according to FIG. 2 is shown.

Figure 12:
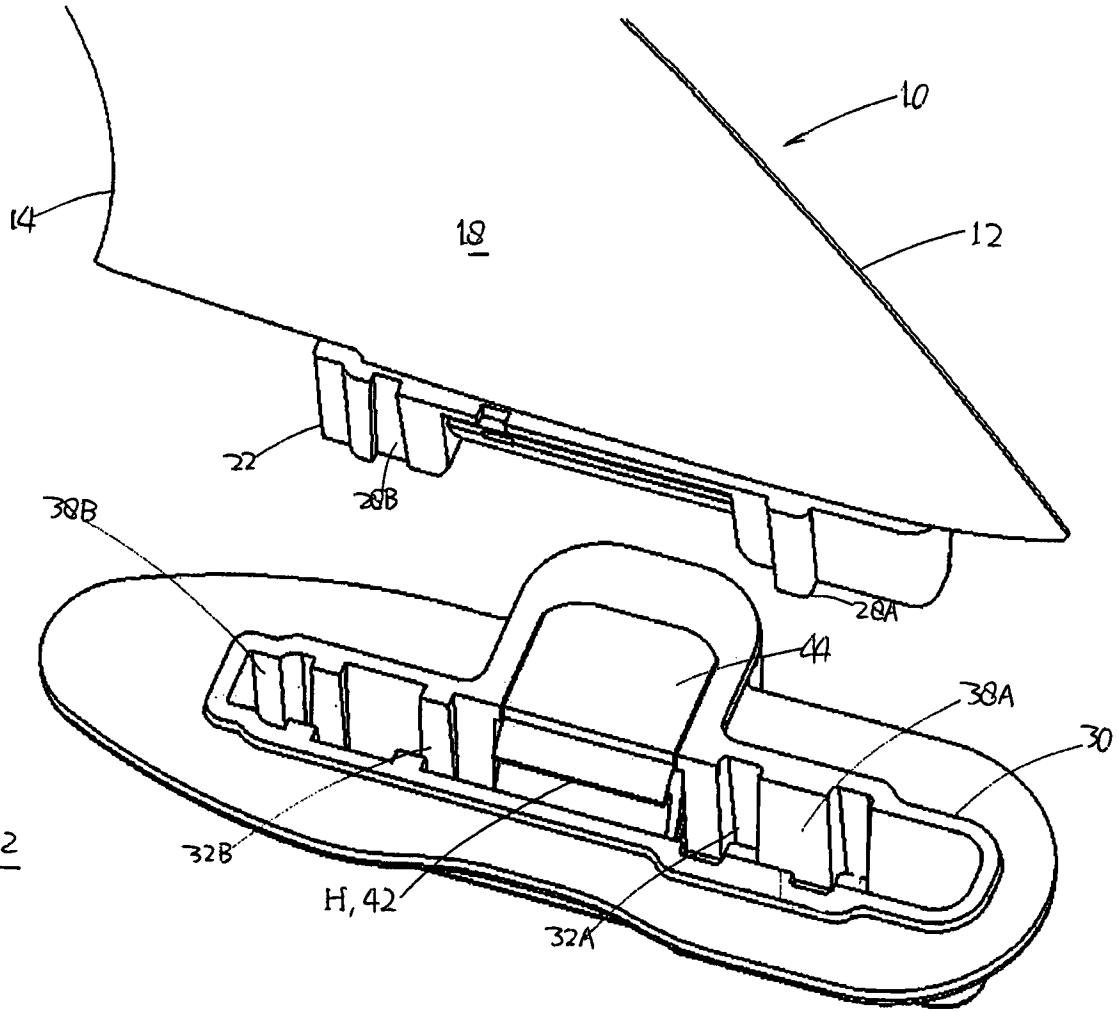
FIG. 12 depicts a perspective view of an assembly of the fin box according to FIG. 2 and the multi-part embodiment of the first fastening means according to FIGS. 4 and 5, and a fin according to FIG. 1 that is to be received in the assembly.
Figure 13:
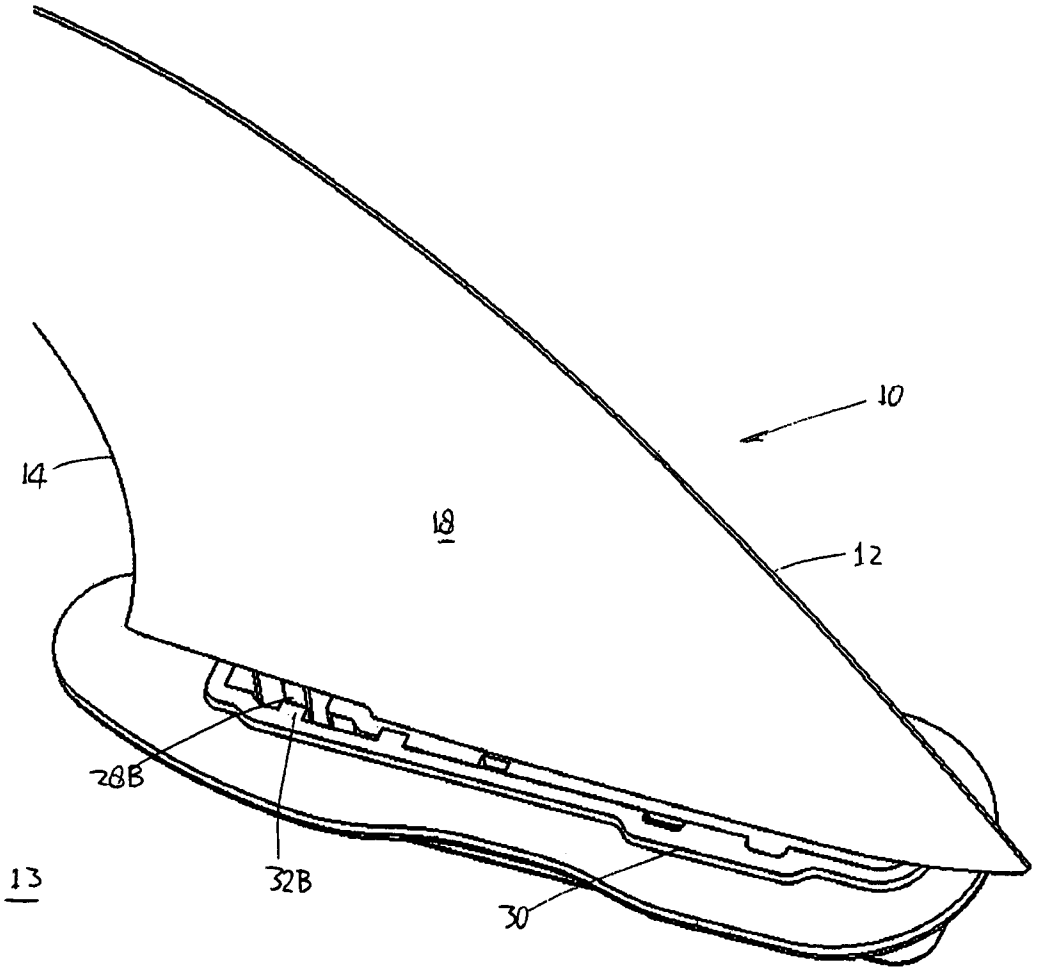
FIG. 13 depicts a perspective view of the result after assembly of the various parts according to FIG. 12.
Figure 14:
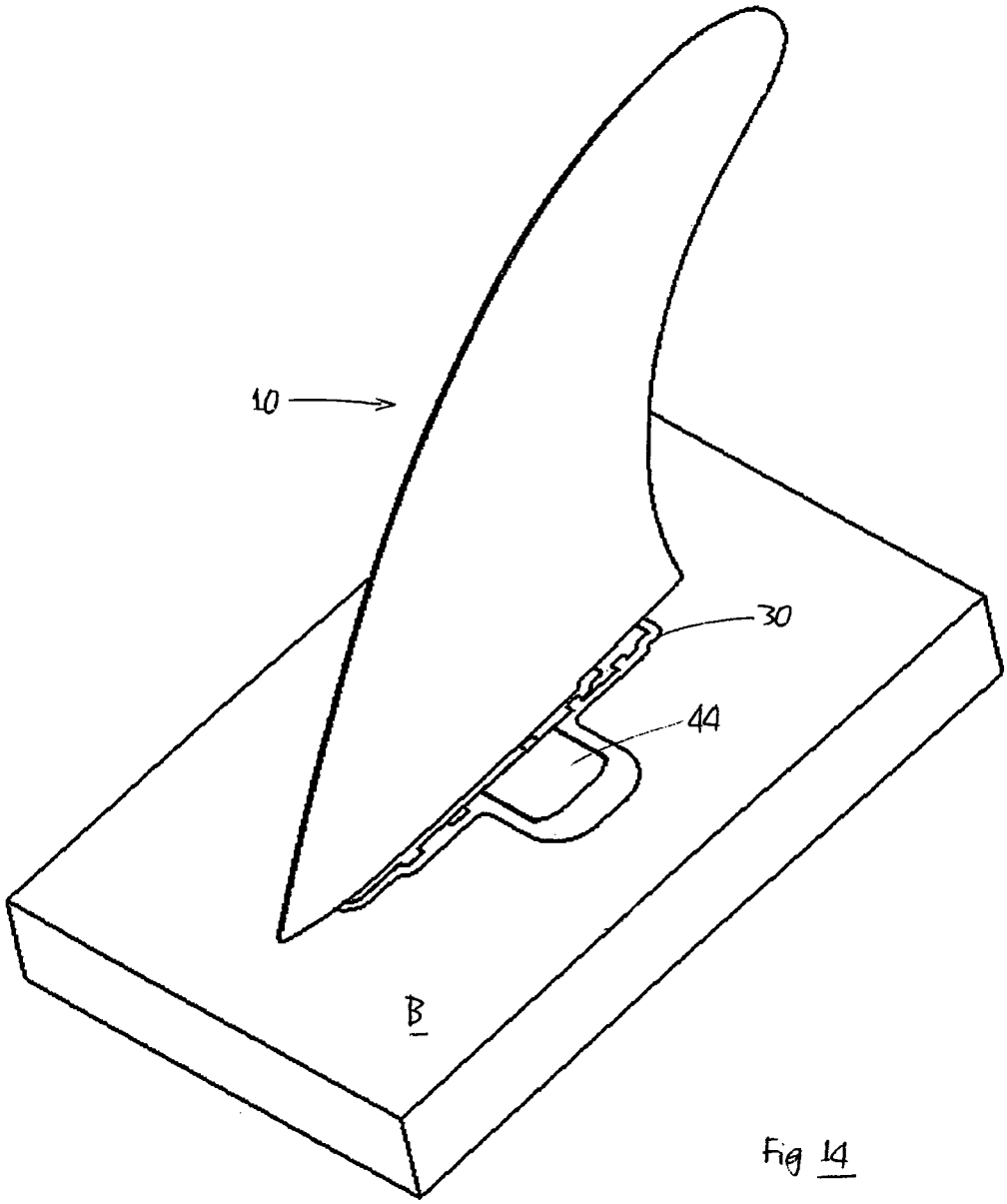
FIG. 14 depicts a perspective view of the assembly according to FIG. 13 when the whole has been taken up in a sailboard.

In FIG. 12 the orientations of a fin 10 and a fin box 30 relative to each other are shown. In FIG. 13 the fin 10 and the fin box 30 according to FIG. 12 are depicted whereby the fin 10 has been taken up in part in the fin box 30. In FIG. 14 the assembly of the fin 10 and fin box is depicted, whereby the fin box 30 has been taken up in the underside or bottom of a sailboard (which is schematically indicated as B) and the footing 22 of the fin 10 in turn has been taken up in whole in the fin box 30.

Figure 15:
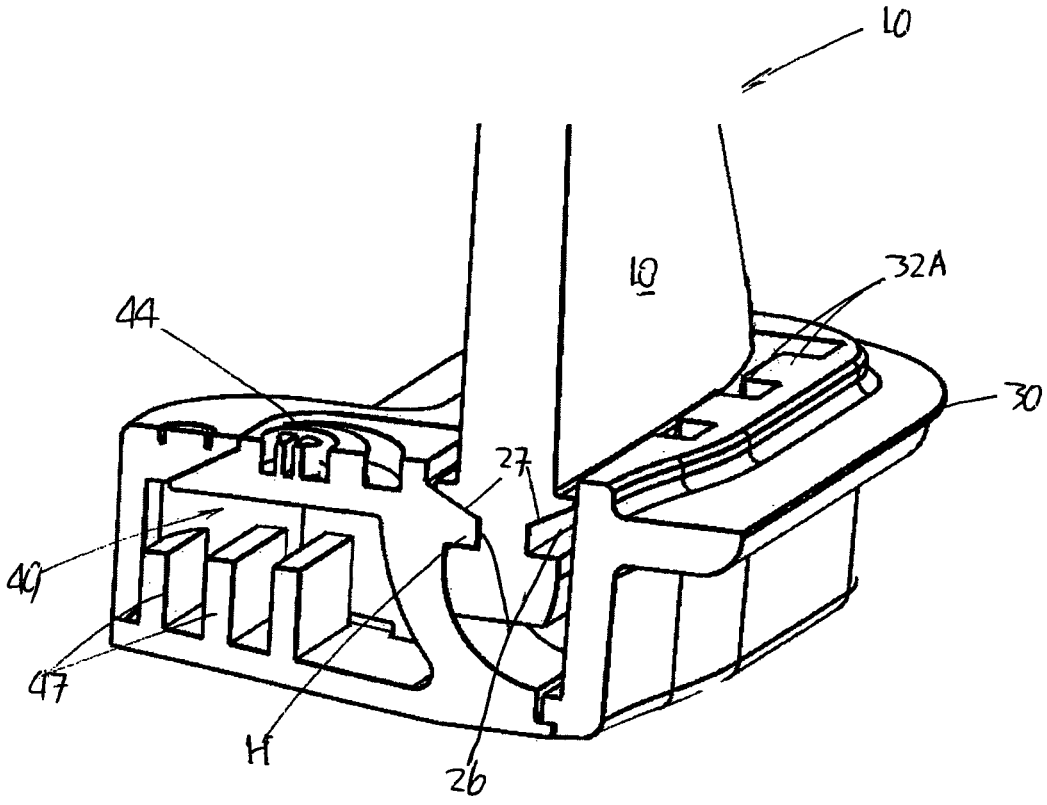
FIG. 15 depicts a cross-sectional view of the connection between the fin box and the fin according to FIG. 13.

In FIG. 15 a cross-sectional view of the fin system according to the invention is depicted. The engagement of the functional hook H (first fastening means) of the fin box 30 with the channel 26 (second fastening means) of the fin 10 can be seen in detail. The channel 26 has at least one beveled plane 27 for the purpose of easing the retraction of the functional hook H from engagement with the channel 26.

Figure 16:
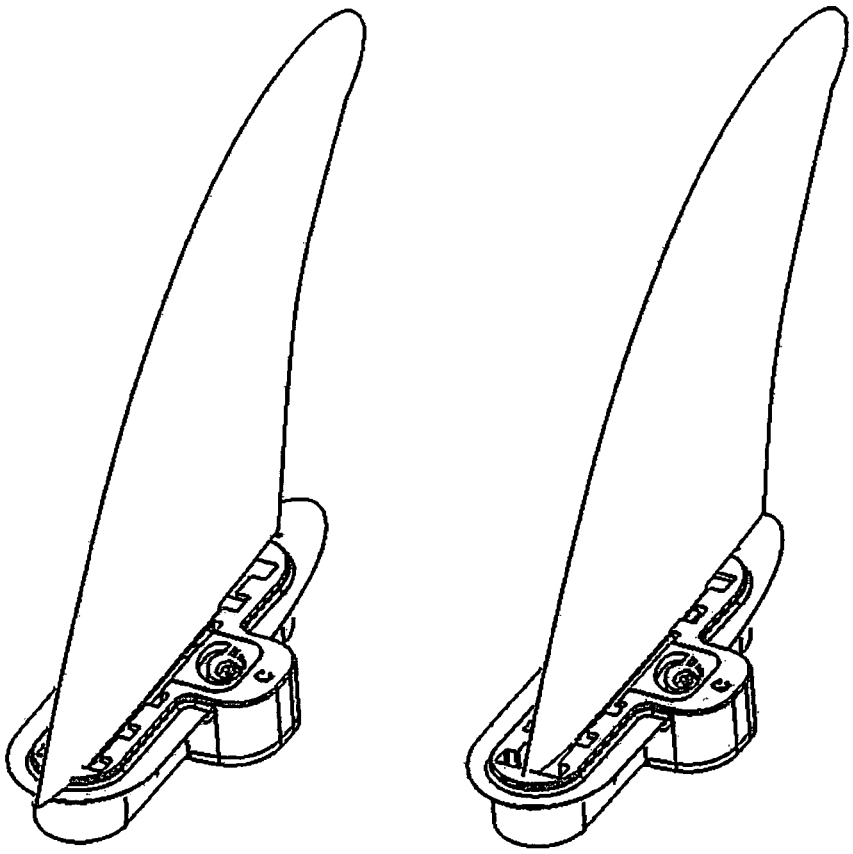
FIG. 16 schematically depicts a view of two positions of the inter-connected fin box and fin according to FIGS. 13 and 15 relative to a sailboard.

In FIG. 16 two positions in which a fin 10 can be received in a fin box 30 are schematically depicted. After being taken up in a sailboard, the fin box 30 has a fixed position; by making the fin 10 adjustable relative to the fin box, a possibility arises of adjusting the fin 10 in the length-wise direction with respect to the sailboard. It shall be clear that the number of different positions in which a fin can be taken up in the fin box is not limited.

Figure 17:
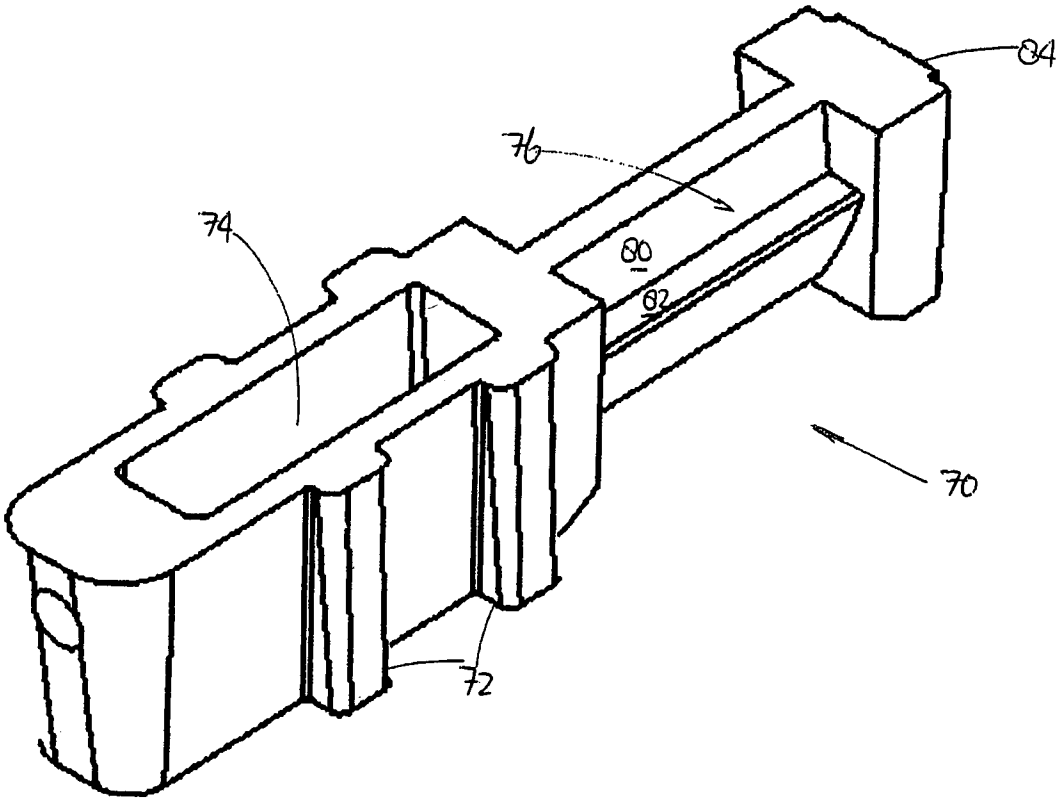
FIG. 17 depicts a perspective view of an auxiliary means or adapter according to the invention.

In FIG. 17 a perspective view of an auxiliary means or adapter according to the invention is shown. This adapter is merely one of the many examples that are imaginable for taking up known types of fin, which fins have a different shape than the fin according to the invention, in a fin box according to the invention and fastening the known types of fin releasably in there. The use of the adapter according to the invention will be described later in conjunction with FIG. 19 and FIG. 20. The adapter 70 is provided with third fastening means, which comprise inter alia substantially vertically orientated notches 72, a receptacle 74, a substantially horizontally extending channel 76—which channel comprises a substantially upright wall 80 and a substantially flatly extending bottom 82—and a vertical side wall 84 that substantially faces away from the side of the receptacle. The part of the adapter 70 around the receptacle 74 forms a footing 78 of the adapter 74.

Figure 18:
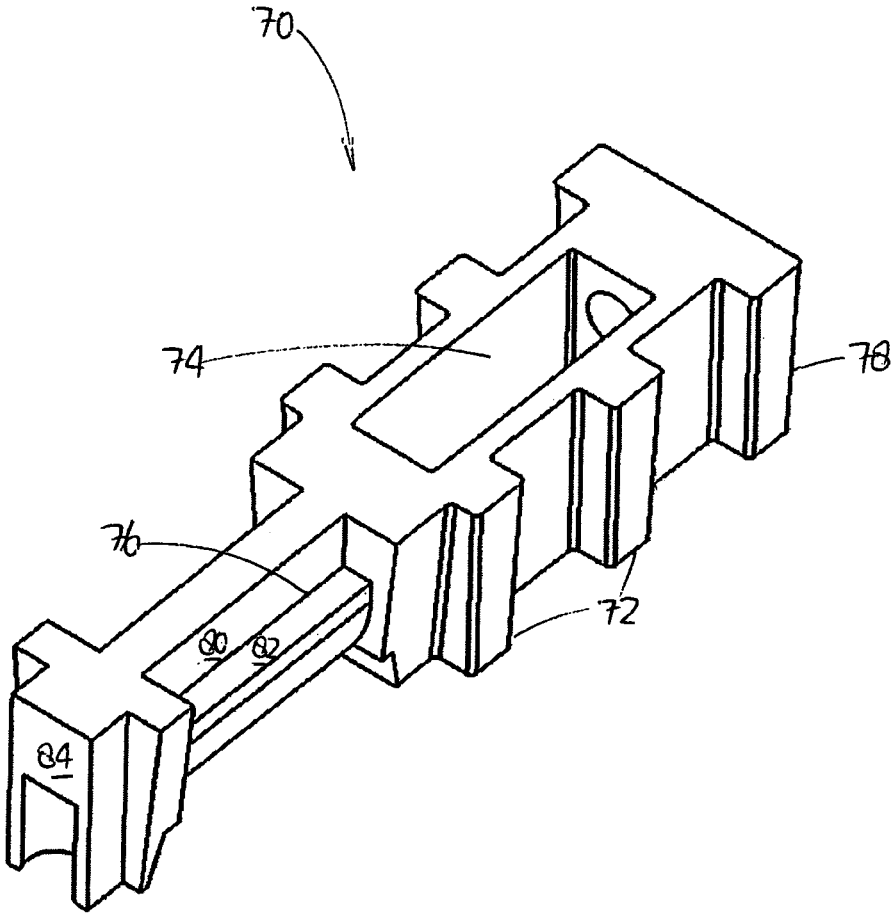
FIG. 18 depicts another perspective view of the adapter according to the invention.

In FIG. 18 another perspective view of the auxiliary means or adapter according to the invention is depicted.

Figure 19:
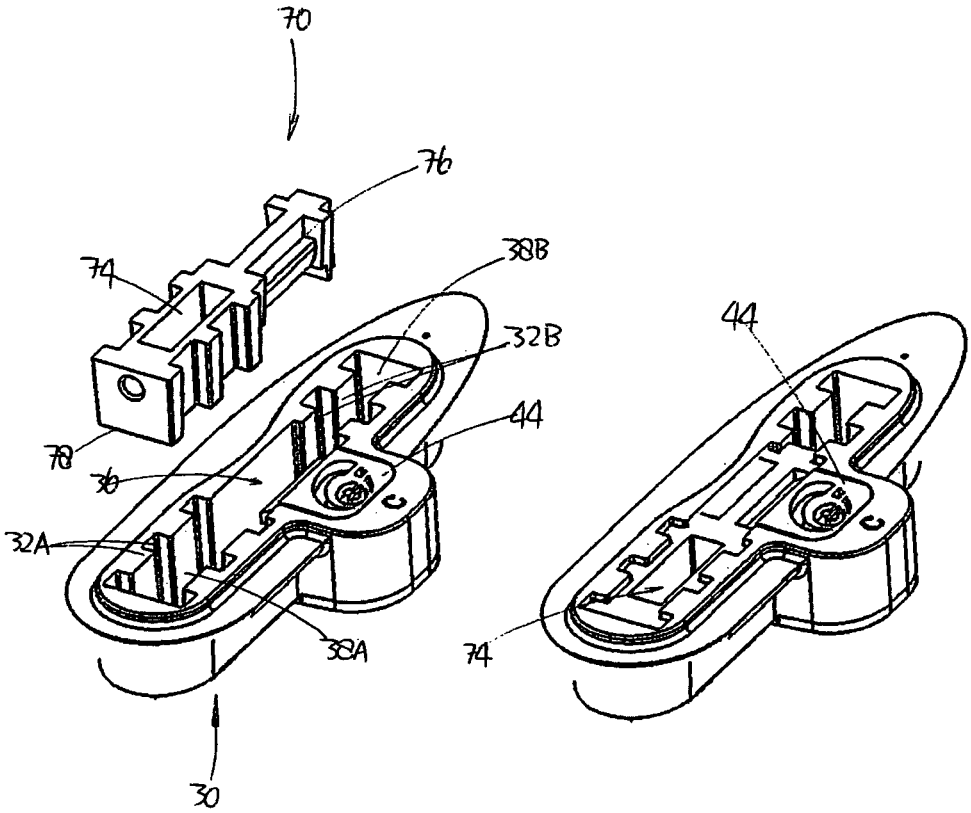
FIG. 19 depicts a view of the positioning of the adapter relative to the fin box according to the invention.

In FIG. 19 the positions of an adapter and a fin box according to the invention relative to each other are shown. In the left-hand side depiction the adapter 70 and the fin box 30 are still separate, and in the right-hand side depiction they both are shown in an assembled state.

Figure 20:
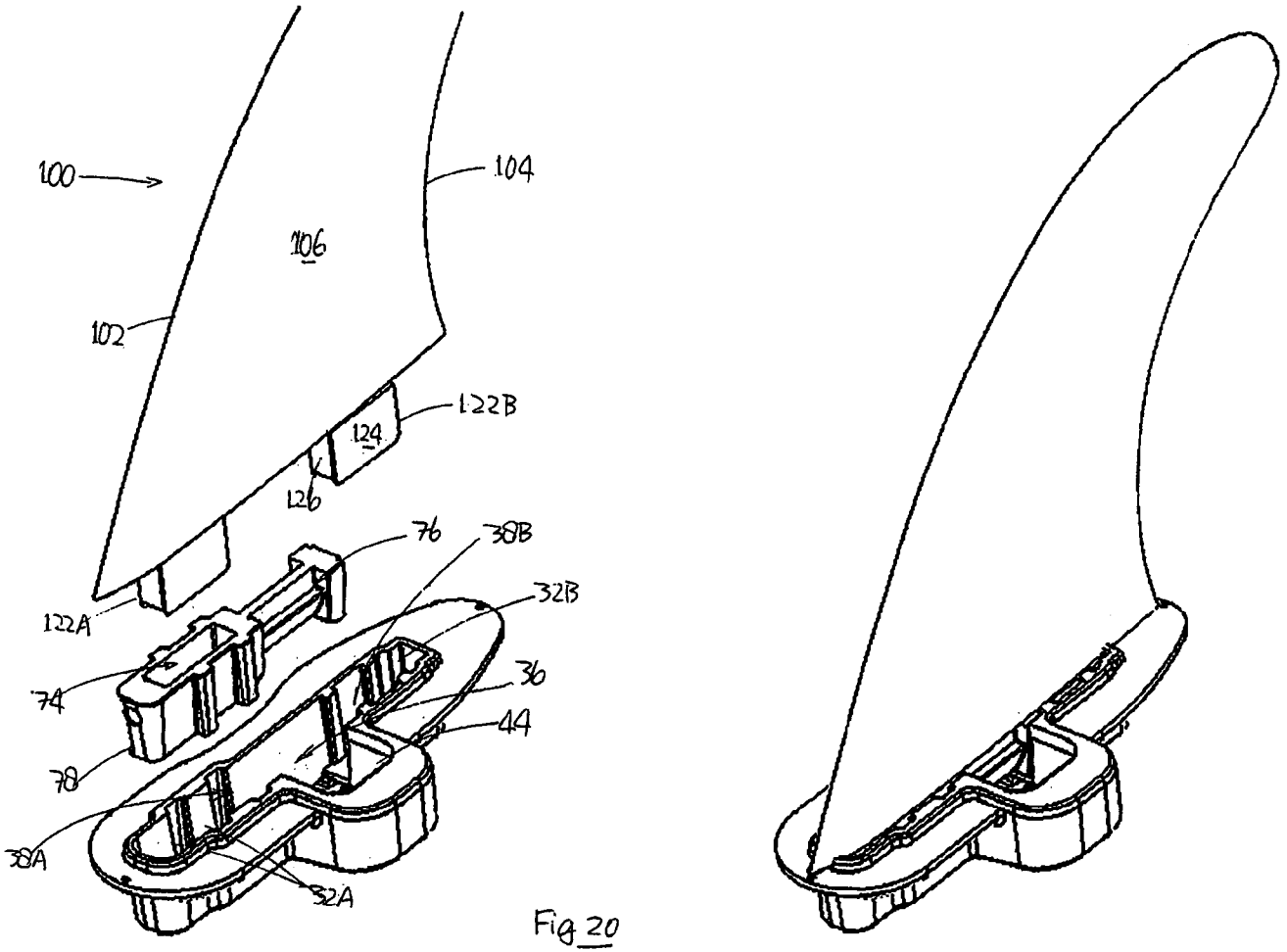
FIG. 20 depicts views of the position of a fin according to the prior art relative to the adapter and the fin box according to the invention in two states of assembly.
Figure 21A:
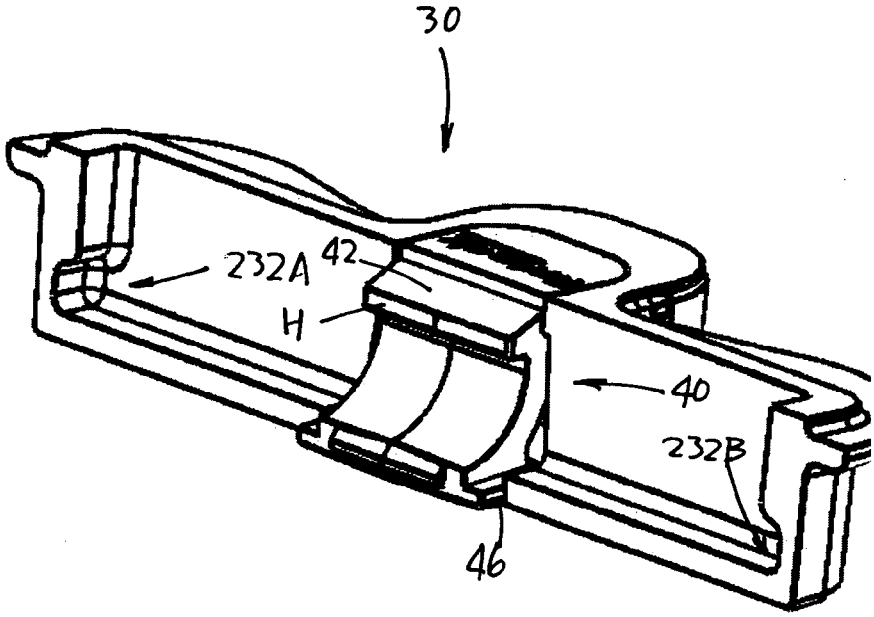
FIG. 21A depicts a perspective view of an alternate embodiment fin box according to the invention.
Figure 21B:
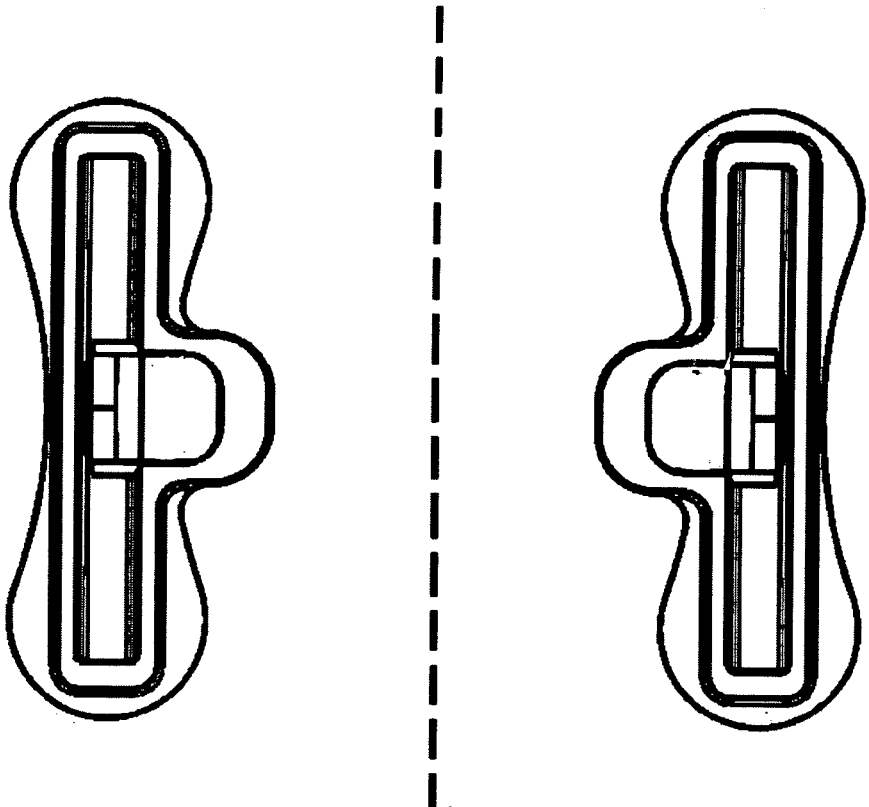
FIG. 21B depicts a top view of the alternate embodiment fin box according to the invention in mirrored positions.
Figure 22:
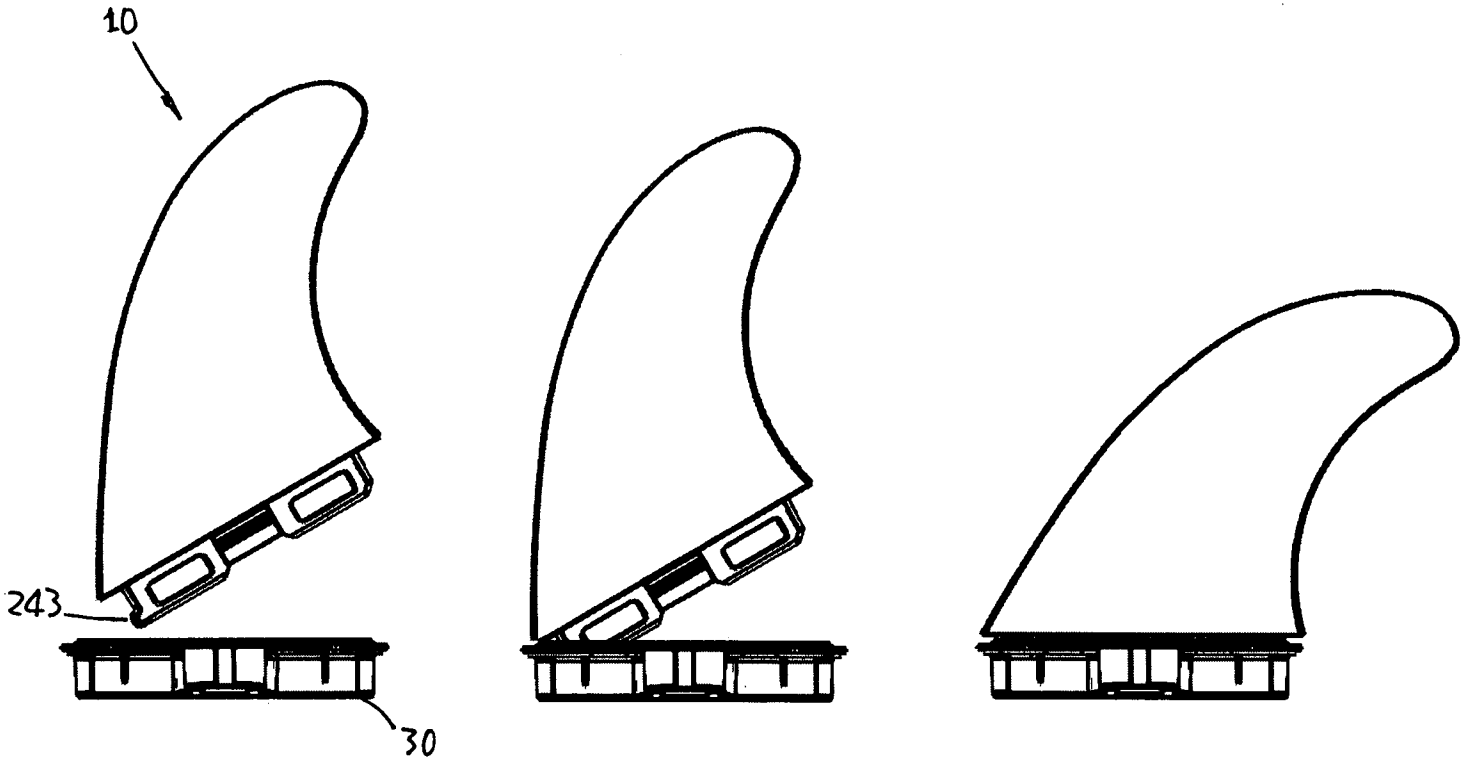
FIG. 22 depicts views of the position of an alternate embodiment fin relative to the alternate embodiment fin box according to the invention in three states of assembly.

In FIG. 20 the positions of a fin according to the prior art and the adapter and the fin box according to the invention relative to each other are shown. As regards the known fin 100, a front side 102, a rear side 104, a side wall 106 and two separate footings 122A and 122B are depicted. A length-wise side 124 and a head side 126 of the footing 122B are denoted. The receptacle 74 of the adapter 74 is dimensioned such that the footing 122A of the known fin 100 can be taken up in a tight fit therein. The side wall 84 of the adapter 74 is dimensioned such that the head side 126 of the known fin 100 can be placed against it in a tight fit. The middle receptacle 36 and the two receptacles 38A and 38B lying at either side thereof of the fin box 30 have been denoted. The compressible means 44 are also depicted in a partly exploded view.

When assembling the adapter 70 and the fin box 30, the footing 78 of the adapter 70 is taken up in a tight fit in the receptacle 32A of the fin box 30. The channel 76 thereby comes to lie in a similar orientation relative to the hook H (not shown here) as has been described above in relation to FIG. 2. With this the adapter 70 fits tightly in the receptacles 36 and 38A of the fin box 30. The adapter can be released easily from the fin box 30 by pressing the resilient means 44 so that space is created between the rib of the hook H and the channel 76 of the adapter. Next, the known fin can be assembled with the adapter 70 and the fin box 30 that have already been assembled together. The footing 122A of the known fin thereby fits tightly in the receptacle 74 of the adapter 70 and the footing 122B fits tightly in the receptacle 38B of the fin box 30 whereby the head side 126 and length-wise side 124 of the footing 122B of the known fin 100 fit tightly in the receptacle 38B. In all fittings that have been mentioned the various ribs and receptacles that have been formed complementarily therewith co-operate as has been described above in relation to FIG. 2.

The embodiments of the present invention that have been described are directed to the receiving and releasably fastening of a fin or daggerboard in a fin box without the use of a tool whereby the fin system forms a substantially closed whole with the surface of the sailboard. It shall be clear that only some of the possible embodiments of the invention have been depicted in the drawings and have been described above. A lot of modifications, such as relating to the number of fin systems, the position thereof relative to the fin, its geometry and the choice of material, can be made without falling outside the scope of the invention.

The invention claimed is:

1. A fin system for connecting a fin to a vessel, said fin system comprising:

a fin box associated with a vessel, said fin box is provided with a first fastening means, said first fastening means comprising a resilient member, at least one hook member extending out from said resilient member, and a part surface extending out from said resilient member in a direction opposite said hook member; and a fin provided with a second fastening means that co-operate with said hook member of said first fastening means of said fin box upon engagement therewith, said second fastening means being a receptacle parallel with a longitudinal axis of said fin;

wherein said first fastening means and said second fastening means form a releasable cantilever connection upon engagement with each other;

wherein said part surface is exposed to an exterior of the vessel when said fin is received in said fin box, and is received into said fin box in order to release said hook member from said second fastening means;

wherein that said formed cantilever connection connects said fin with a surface of the vessel, said part surface of said hook member is configured to not interfere with a flow of water in contact with the surface of the vessel.

2. The fin system according to claim 1, wherein said fin box further comprising one or more ribs and receptacles that co-operate with corresponding receptacles and ribs of said fin that is to be taken up in said fin box in one or more positions relative to said fin box.

3. The fin system according to claim 2, wherein said first fastening means further comprising a defined space configured to receive a part of said part surface when depressing said part surface.

4. The fin system according to claim 3, wherein said fin box is provided with a stop that extends into said space in a direction perpendicular to a longitudinal axis of said fin box for limiting a degree of retraction of said hook member.

5. The fin system according to claim 1, wherein said part surface further comprises a beveled plane received in said fin box and configured to contact an upper edge of said fin box.

6. The fin system according to claim 1, wherein said hook member further comprising a beveled plane at a side thereof to allow retraction into the vessel.

7. The fin system according to claim 1, wherein said receptacle of said second fastening means comprises a beveled plane at a side thereof which comes into contact with said beveled plane of said hook member during engagement.

8. The fin system according to claim 7, wherein said receptacle of said second fastening means extends across at least a part of a breadth of said fin.

9. The fin system according to claim 8, wherein said receptacle of said second fastening means extends substantially horizontally, and wherein said fin further comprising at least one footing extending from a base of said fin adjacent said second fastening means, said footing being receivable in said fin box.

10. The fin system according to claim 9, wherein said second fastening means further comprising a plurality of ribs and receptacles that co-operate with corresponding receptacles and ribs of said fin box in which said fin is to be taken up in one or more positions relative to said fin box.

11. A fin system for connecting a fin to a vessel, said fin system comprising:

a fin box associated with a vessel, said fin box being provided with a resilient member, a hook, one or more ribs and receptacles, a part surface extending away from said resilient member in a direction opposite said hook, and a defined space configured to receive a part of said part surface when depressing said part surface, said space being provided with a stop for limiting a degree of retraction of said part surface;

a fin provided with at least two fin footings extending from a base of said fin, a hook receptacle for releasably receiving and engaging said hook of said fin box, and one or more fin ribs and fin receptacles that co-operate with corresponding said receptacles and ribs of said fin box, said hook receptacle being between said fin footings;

wherein said part surface is exposed to an exterior of the vessel when said fin is received in said fin box, and is received into said fin box in order to release said hook from said hook receptacle.

12. The fin system according to claim 11, wherein said hook has a portion exposed to an exterior of said fin box that is receivable in said space defined in said fin box in order to release said hook from said hook receptacle of said fin.

13. The fin system according to claim 12, wherein said part surface further comprises a beveled plane received in said fin box and configured to contact an upper edge of said fin box.

14. The fin system according to claim 9, wherein said footing of said fin is at least two footings with said hook receptacle located between said footings.

15. The fin system according to claim 9, wherein said one or more fin ribs and fin receptacles of said fin are associated with said footing.

16. The fin system according to claim 1, wherein said first fastening means further comprises at least one projection extending out therefrom, said projection is configured to be received in a corresponding receptacle defined in said fin box.

17. The fin system according to claim 16, wherein said first fastening means is receivable in an additional receptacle defined in said fin box and through a base of said fin box.

18. The fin system according to claim 1, wherein said part surface is configured to be substantially flush with a portion of said fin box adjacent thereto and exterior of the vessel when said part surface is in a non-depressed position.

* * * * *